US009192197B2

(12) United States Patent
Reinhard

(10) Patent No.: US 9,192,197 B2
(45) Date of Patent: Nov. 24, 2015

(54) POST SURGICAL RECOVERY BRA

(71) Applicant: Sharon S. Reinhard, Malvern, PA (US)

(72) Inventor: Sharon S. Reinhard, Malvern, PA (US)

(73) Assignee: Sharon S. Reinhard, Malvern, PA (US)

( * ) Notice: Subject to any disclaimer, the term of this patent is extended or adjusted under 35 U.S.C. 154(b) by 147 days.

(21) Appl. No.: 14/045,876

(22) Filed: Oct. 4, 2013

(65) Prior Publication Data

US 2015/0099420 A1 Apr. 9, 2015

(51) Int. Cl.
*A41C 3/00* (2006.01)
*A41C 3/02* (2006.01)

(52) U.S. Cl.
CPC ..... *A41C 3/0064* (2013.01); *A41C 3/02* (2013.01)

(58) Field of Classification Search
CPC ..... A41C 1/00; A41C 1/02; A41C 1/06; A41C 3/00; A41C 3/0014; A41C 3/0028; A41C 3/005; A41C 3/064; A41C 3/0057; A41C 3/02
USPC ..... 450/1, 58, 54–57, 64–74, 77, 79, 86, 450/30–33
See application file for complete search history.

(56) References Cited

U.S. PATENT DOCUMENTS

| | | | | | |
|---|---|---|---|---|---|
| 3,561,442 | A * | 2/1971 | Goswitz | 602/41 |
| 4,325,378 | A * | 4/1982 | Wilkinson | 450/77 |
| 4,444,191 | A * | 4/1984 | Harned | 450/58 |
| 4,781,651 | A * | 11/1988 | Ekins | 450/79 |
| 5,098,331 | A * | 3/1992 | Corrado | 450/58 |
| 5,643,043 | A * | 7/1997 | Pflum | 450/86 |
| 5,968,003 | A * | 10/1999 | Sisson | 602/75 |
| 6,755,717 | B2 | 6/2004 | Smith | |
| 7,909,675 | B1 * | 3/2011 | Rainey | 450/59 |
| 8,317,569 | B2 * | 11/2012 | Fisher-Pacheco | 450/79 |
| 8,790,154 | B2 * | 7/2014 | Blackwell | 450/86 |
| 8,832,862 | B1 * | 9/2014 | Solis | 2/67 |
| 8,858,295 | B2 * | 10/2014 | Thompson | 450/62 |
| 8,900,032 | B2 * | 12/2014 | Punsal | 450/31 |
| 2013/0065486 | A1 * | 3/2013 | Hansen | 450/59 |
| 2013/0115852 | A1 * | 5/2013 | Blackwell | 450/58 |
| 2013/0316616 | A1 * | 11/2013 | Thompson | 450/66 |

* cited by examiner

*Primary Examiner* — Gloria Hale

(57) ABSTRACT

A post surgical recovery bra may include at least one shoulder strap with an adjustable mechanism, a bra body, a compression band, a padded band and an adjustment band. The bra body may have a top portion, a first side, a second side, a thorax portion, a rear portion and may include a front closure component. The shoulder strap may attach to the top portion of the bra body. The compression band may be attached to the bra body and extend around the wearer across the chest, and may include a second front closure component. The padded band may cover the thorax portion of the bra body, or be within a pocket within the thorax portion of the bra body. The adjustment band may be positioned over the padded band.

12 Claims, 3 Drawing Sheets

POST SURGICAL RECOVERY BRA

BACKGROUND OF THE INVENTION

The present invention relates to bras and, more particularly, to post-surgical recovery bras.

Currently, there is an unmet medical need for a post surgical bra that is practical, comfortable and provides adequate support from the time of leaving the operating room through roughly 6 months of follow-up care to ensure a complete medical recovery and the best aesthetic outcome possible. The post surgical bras today do not allow for easy adjustment of the shoulder strap which creates discomfort when moving from a seated to supine position. Many post surgical bras are comprised of Velcro® or the like for a front closure. The Velcro® may get caught in the gauze dressing that protects the wound and may result in pulling the gauze or stitches resulting in pain and/or injury. The current bras have elastic banding around the thorax which causes pain to surgical incisions. Most patients are wrapped, separately, in an ace bandage which is difficult to reapply when the patient is on their own without assistance to re-wrap them. The current bras also do not fit properly nor assist in securing any drains/tubing that may remain extending from incisions without the use of tape. Most patients are instructed to continue to wear the poorly designed post-surgical bra for 2 weeks and then told to avoid the use of underwire bras for several months. During this recovery period which may be an additional 3 to 6 months, there are few options available that are easy to take on and off, that do not apply painful pressure to incisions or that mobilize the breast in an ideal position.

As can be seen, there is a need for a post surgical recovery bra that is comfortable, easy to wear and adjust, does not get caught on gauzes or stitches and avoids the need for separate compression dressings.

SUMMARY OF THE INVENTION

In one aspect of the present invention, a post surgical recovery bra comprises at least one shoulder strap with an adjustment mechanism; a bra body having a top portion, a first side, a second side, a thorax portion, and a rear portion, the bra body comprising a front closure component, wherein the front closure component removably attaches the first side and the second side, wherein the at least one shoulder strap attaches to the top portion of the bra body; a compression band attached to the rear portion of the bra body, extended from the rear portion across a chest of a wearer, the compression band comprising a second front closure component, wherein the compression band is positioned over the bra body; a padded band covering the thorax portion of the bra body; and an adjustment band attached to and positioned over the padded band, the adjustment band comprising a third front closure component.

In another aspect of the present invention, a post surgical recovery bra comprises at least one shoulder strap with an adjustment mechanism; a bra body having a top portion, a first side, a second side, a thorax portion, a rear portion and comprising: a pocket within the thorax portion of the bra body; and a front closure component, wherein the front closure component removably attaches the first side and the second side, wherein the at least one shoulder strap attaches to the top portion of the bra body; a compression band attached to the rear portion of the bra body, extended from the rear portion across a chest of a wearer, the compression band comprising a second front closure component, wherein the compression band is positioned over the bra body; a padded band positioned within the pocket within the thorax portion of the bra body; and an adjustment band attached to and positioned over the padded band, the adjustment band comprising a third front closure component.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a post surgical recovery bra may include at least one shoulder strap with an adjustable mechanism, a bra body, a compression band, a padded band and an adjustment band. The bra body may have a top portion, a first side, a second side, a thorax portion, a rear portion and may include a front closure component. The shoulder strap may attach to the top portion of the bra body. The compression band may be attached to the bra body and extend around the wearer across the chest, and may include a second front closure component. The padded band may cover the thorax portion of the bra body, or be within a pocket within the thorax portion of the bra body. The adjustment band may be positioned over the padded band.

An embodiment of the present invention may provide for the adjustment and compression of the breast as well as adjustment of the bra to provide compression of the breast so that there is a prevention of pain or potential injury to the recovering breast. This adjustment and compression may minimize swelling and allow the breast to be positioned properly with support to minimize pain and to promote a better long term aesthetic outcome. The wearer may be able to easily open the post surgical recovery bra without fully removing it in order to clean their wounds, replace surgical dressings and apply ice. The wearer may also be able to adjust the bra to fit properly in both the seated and supine positions.

Figure 1:
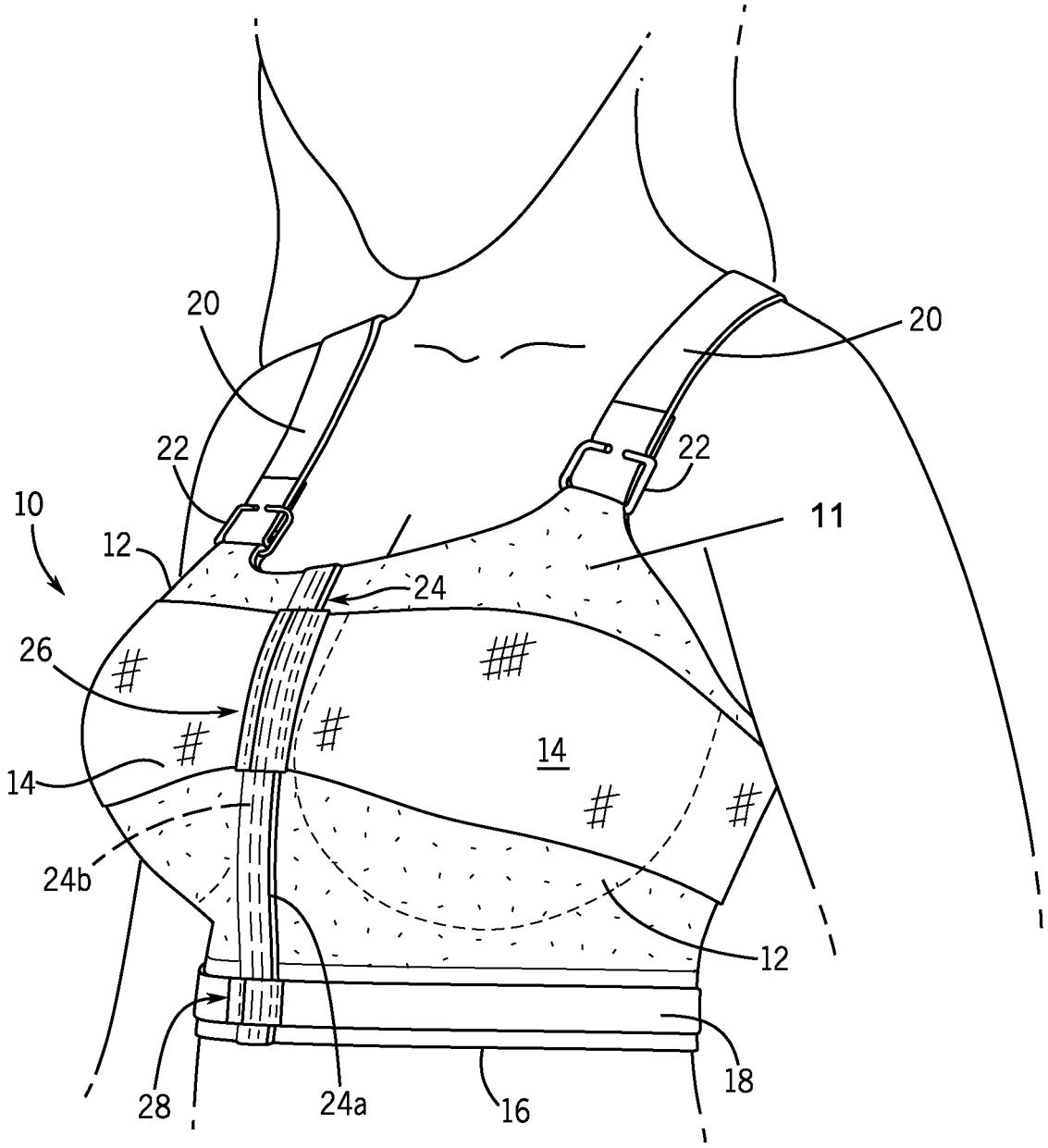
FIG. 1 is a front perspective view of a post surgical recovery bra, worn by a user, according to an exemplary embodiment of the present invention.
Figure 2:
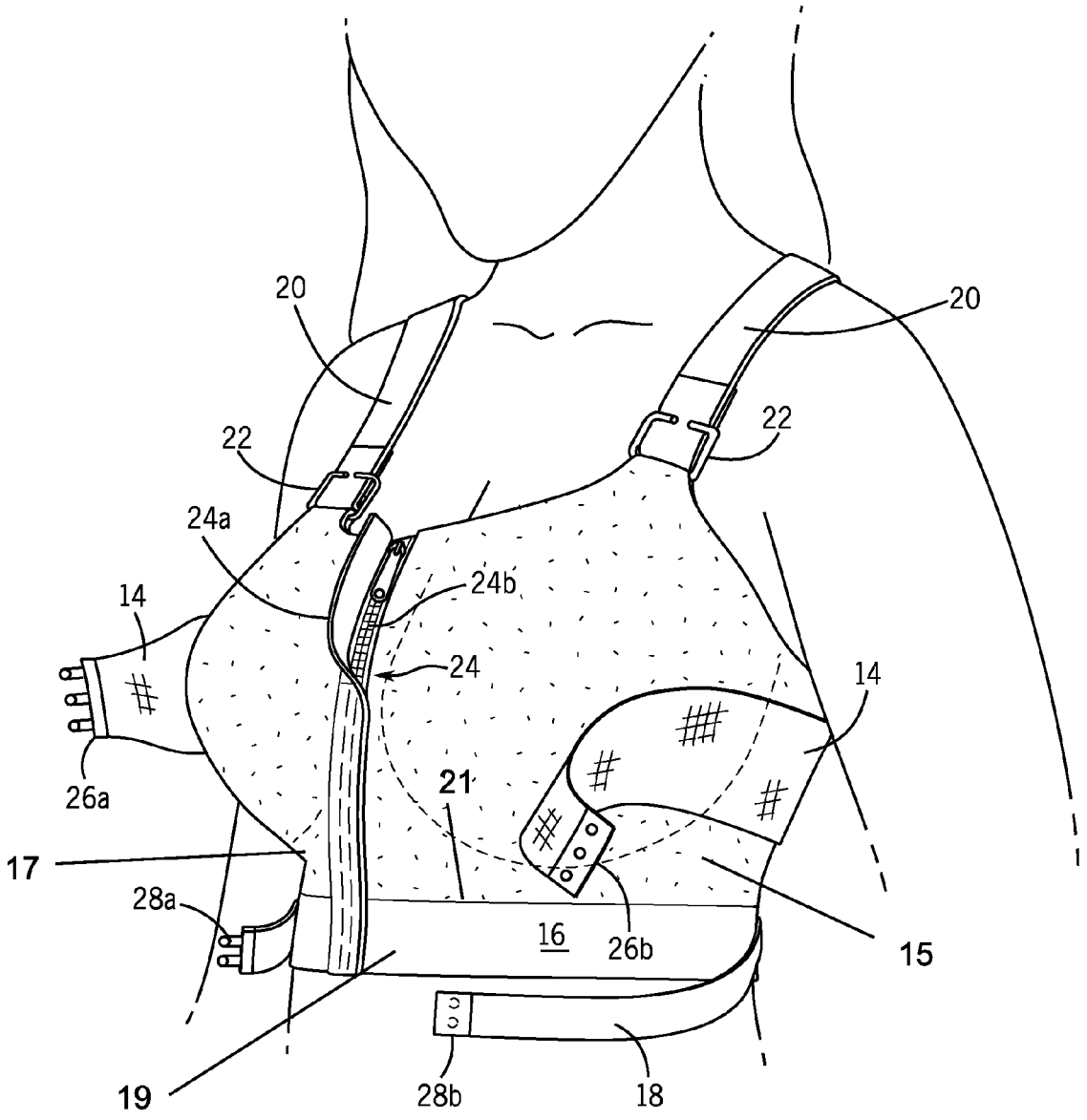
FIG. 2 is a front perspective view of the post surgical recovery bra of FIG. 1, with certain elements detached.
Figure 3:
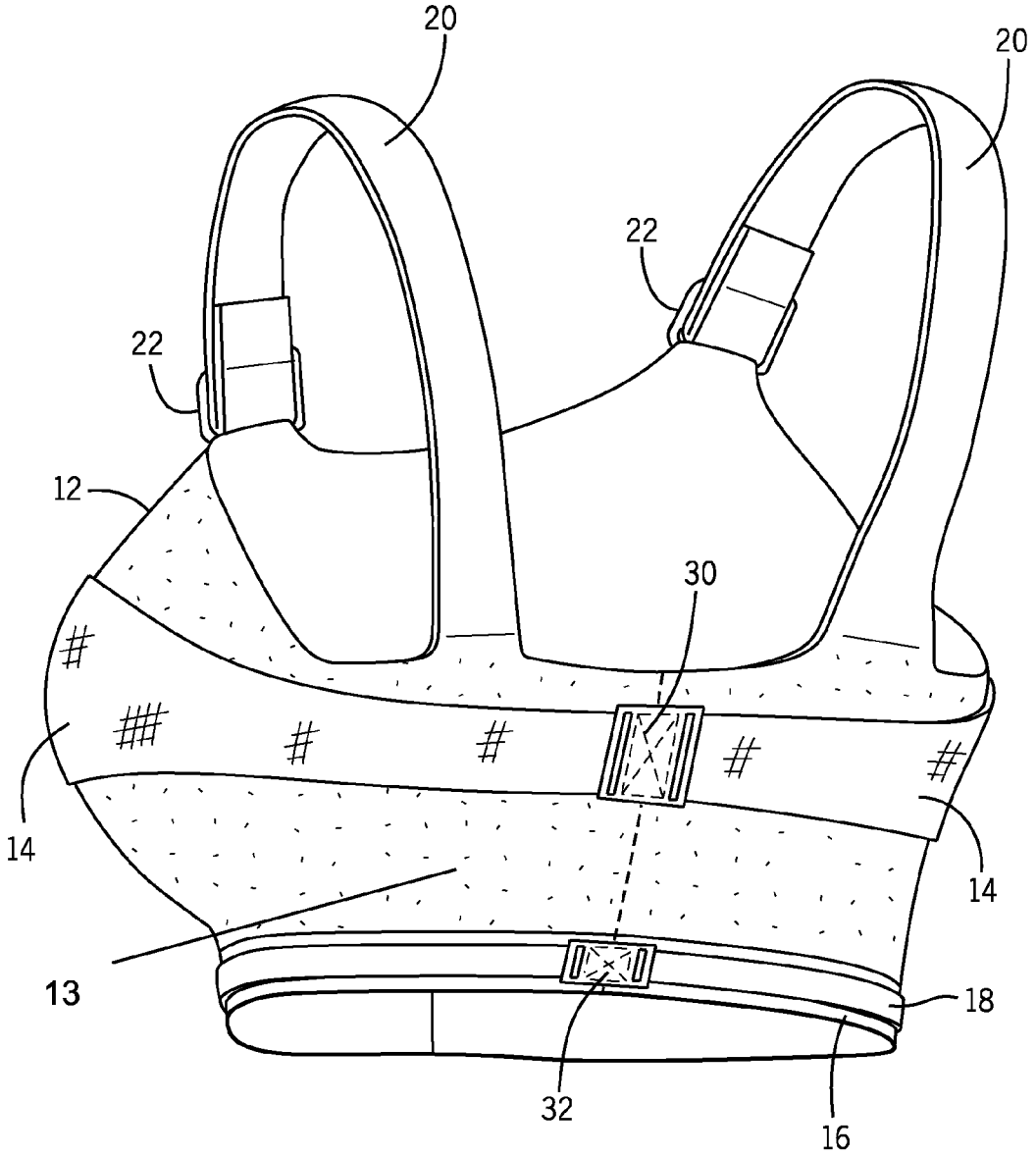
FIG. 3 is a rear perspective view of the post surgical recovery bra of FIG. 1.

As is illustrated in FIGS. 1 through 3, a post surgical recovery bra 10 may include a bra body 12. The bra body 12 may wrap around an individual and may comprise a front closure component 24. The front closure component 24 removably attaches a first side 15 and a second side 17 of the bra body 12. The front closure component 24 may comprise a zipper 24*b*, a clasp or the like. The front closure component 24 may be covered by a flap 24*a*. Along a top portion 11 of the bra body 12 may be at least one shoulder strap 20. The at least one shoulder strap 20 may have an adjustment mechanism 22, such as an adjuster clip or the like that allows for the adjustment of the at least one shoulder strap 20.

In certain embodiments, a compression band 14 may be attached with thread 30 or the like to a rear portion 13 of the bra body 12. The compression band 14 may extend from the rear portion 13 across a chest of a wearer. The compression band 14 may comprise a second front closure component 26. The second front closure component 26 may comprise a clasp system or the like, with a first clasp portion 26*a* and a second clasp portion 26*b*. The compression band 14 may be positioned over the bra body 12 across the chest of the wearer allowing for the proper positioning of the breast and to reduce swelling.

In certain embodiments, a padded band 16 may be placed around a thorax portion 19 of the bra body 12. In certain embodiments the thorax portion 19 of the bra body 12 may have a pocket 21. The padded band 16 may be positioned within the pocket 21 of the bra body 12. The padded band 16 may be positioned at or below incision lines so that the padded band 16 may provide cushion if pressed against the incisions or stitches from a surgery. An adjustment band 18 may be attached with thread 32 or the like to the bra body 12 and positioned over the padded band 16. In certain embodiments the adjustment band 18 may be directly attached 32 to the bra body thorax portion 19 while the padded band 16 may be positioned within the pocket along the thorax portion 19 of the bra body 12. The adjustment band 18 may have a third front closure component 28. The third front closure component 28 may comprise a clasp system or the like, with a first clasp portion 28*a* and a second clasp portion 28*b*. The adjustment band 18 may allow for the positioning of the thorax portion 19 of the bra body and to tighten the post surgical recovery bra for a customized fit. In addition, the adjustment band 18 may allow for the securing of any post-surgical drains/tubing that extend from incisions until removed by a surgeon.

A method of using the post surgical recovery bra may be for post surgical use following breast augmentation, mastopexy, reduction or reconstruction. These procedures involve incisions around the nipple, down the front of the breast and under the breast. The post surgical recovery bra may provide support, comfort, ease of access, compression and individualized sizing. A post surgical bra is required for 2-4 weeks following the breast procedure and recommended for up to 6 months following to ensure a complete medical and aesthetic recovery. The patient may wear the post surgical recovery bra during the day, for exercise and for sleeping to ensure the best outcome. In certain embodiments large breasted women may also benefit from the features of this bra allowing for comfort and breast health.

It should be understood, of course, that the foregoing relates to exemplary embodiments of the invention and that modifications may be made without departing from the spirit and scope of the invention as set forth in the following claims.

What is claimed is:

1. A post surgical recovery bra comprising:

a bra body comprising a rear portion interconnecting a first side and a second side, wherein the bra body is adapted to wrap around an upper body portion of a human wearer so that the first side is disposed over approximately a left half of a chest of the human wearer and the second side is adjacent to the first side and disposed over approximately a right half of the chest;

a thorax portion defining a lower periphery of the bra body;

a front closure component, wherein the front closure component removably attaches adjacent portions of the first side and the second side;

a compression band attached to the rear portion of the bra body, wherein the compression band extends from the rear portion in two opposing directions across the first side and the second side so as to be connectable by a second front closure component;

a padded band covering the thorax portion of the bra body; and an adjustment band attached to and positioned over the padded band, the adjustment band comprising a third front closure component.

2. The post surgical recovery bra of claim 1, wherein the adjustment mechanism comprises an adjuster clip.

3. The post surgical recovery bra of claim 1, wherein the front closure component comprises a zipper.

4. The post surgical recovery bra of claim 1, wherein the second front closure component comprises a clasp system.

5. The post surgical recovery bra of claim 1, wherein the adjustment band is made from elastic.

6. The post surgical recovery bra of claim 1, further comprising a flap covering the front closure component on the bra body.

7. A post surgical recovery bra comprising:

a bra body comprising a rear portion interconnecting a first side and a second side, wherein the bra body is adapted to wrap around an upper body portion of a human wearer so that the first side is disposed over approximately a left half of a chest of the human wearer and the second side is adjacent to the first side and disposed over approximately a right half of the chest;

a thorax portion defining a lower periphery of the bra body;

a pocket within the thorax portion of the bra body; and a front closure component, wherein the front closure component removably attaches adjacent portions of the first side and the second side;

a compression band attached to the rear portion of the bra body, wherein the compression band extends from the rear portion in two opposing directions across the first side and the second side so as to be connectable by a second front closure component;

a padded band positioned within the pocket within the thorax portion of the bra body; and an adjustment band attached to and positioned over the padded band, the adjustment band comprising a third front closure component.

8. The post surgical recovery bra of claim 7, wherein the adjustment mechanism comprises an adjuster clip.

9. The post surgical recovery bra of claim 7, wherein the front closure component comprises a zipper.

10. The post surgical recovery bra of claim 7, wherein the second front closure component comprises a clasp system.

11. The post surgical recovery bra of claim 7, wherein the adjustment band is made from elastic.

12. The post surgical recovery bra of claim 7, further comprising a flap covering the front closure component on the bra body.

* * * * *